United States Patent [19]

Hirst et al.

[11] 4,236,871

[45] Dec. 2, 1980

[54] CENTRIFUGAL FAN IMPELLERS WITH BLADES SECURED BETWEEN PLATES

[75] Inventors: Peter B. Hirst, Billingshurst; Anthony J. Duthie, Horsham, both of England

[73] Assignee: Johnston Brothers (Engineering) Limited, Redhill, England

[21] Appl. No.: 866,785

[22] Filed: Jan. 3, 1978

[51] Int. Cl.[3] ..... F04D 29/28

[52] U.S. Cl. ..... 416/186 R; 416/224

[58] Field of Search ..... 416/186, 214, 224, 241 R, 416/244

[56] References Cited

U.S. PATENT DOCUMENTS

| | | | |
|---|---|---|---|
| 1,036,627 | 9/1912 | Huguenin | 416/186 |
| 1,676,946 | 12/1926 | Fechheimer | 416/186 |
| 1,983,201 | 12/1934 | Van Rijswijk | 416/186 |
| 3,368,744 | 2/1968 | Jenn | 416/186 |

FOREIGN PATENT DOCUMENTS

| | | | |
|---|---|---|---|
| 968553 | 3/1958 | Fed. Rep. of Germany | 416/186 |
| 2610362 | 9/1977 | Fed. Rep. of Germany | 416/224 |
| 290437 | 3/1963 | Netherlands | 416/186 |
| 161388 | 7/1933 | Switzerland | 416/186 |
| 464608 | 4/1937 | United Kingdom . | |
| 545650 | 6/1942 | United Kingdom . | |
| 625658 | 7/1949 | United Kingdom . | |
| 707810 | 4/1954 | United Kingdom | 416/186 |
| 1323509 | 7/1973 | United Kingdom . | |
| 298763 | 3/1971 | U.S.S.R. | 416/186 |

*Primary Examiner*—Everette A. Powell, Jr.
*Assistant Examiner*—A. N. Trausch, III
*Attorney, Agent, or Firm*—Young & Thompson

[57] ABSTRACT

A fan impeller comprises a back plate, a front plate and a plurality of blades fixedly attached between the front plate and the back plate. Two bars are welded to the back of each blade and are bolted to the front and back plates. Each blade is a channel section member having a base and two sides, the base being normal to the planes of the front and back plates of the impeller, one side lying along the front plate and the other side lying along the back plate. The sides extend from the base in the direction of rotation of the impeller in use so that the inside of each channel section is presented to the airstream as the impeller rotates. The inside working surface of each blade may be hardened to a minimum hardness of Rockwell C55.

1 Claim, 7 Drawing Figures

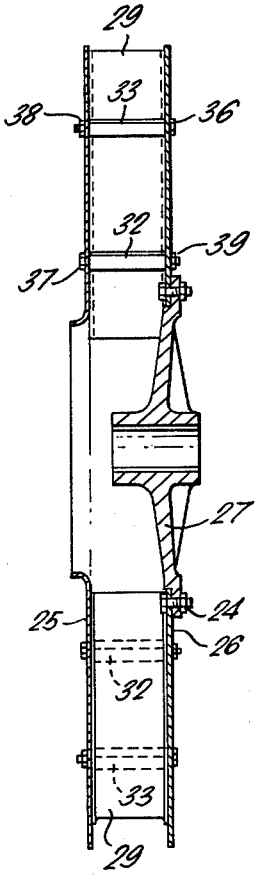
FIG. 4.
FIG. 7.
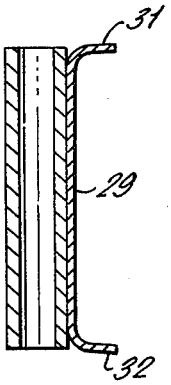
FIG. 5.
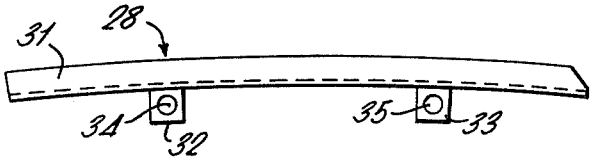
FIG. 6.
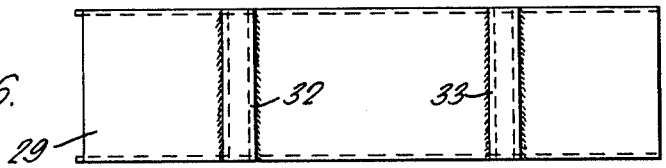

CENTRIFUGAL FAN IMPELLERS WITH BLADES SECURED BETWEEN PLATES

The invention relates to fan impellers, more particularly but not exclusively for use in road sweepers.

The invention provides a fan impeller comprising a back plate, a front plate, a plurality of blades fixedly attached between the front plate and the back plate, and a plurality of bars lying between and normal to the back plate and the front plate, each bar being fixedly attached at one end to the back plate and at the other end to the front plate.

Each bar may be welded to a blade. The blades preferably each comprise a channel section member having a base and two sides, each blade being fixed between the front and back plates of the impeller with its base normal to the planes of the front plate and the back plate, one side of each blade lying along the back plate and the other side of each blade lying along the front plate, and both sides of each blade extending from the base in the direction of rotation of the impeller in use. The arrangement presents the inside of each channel section to the airstream as the impeller rotates.

The inside working surfaces of each blade may be hardened to a predetermined Rockwell number to resist abrasion and is preferably hardened to a minimum hardness of Rockwell C55.

The blades may be straight or curved and are preferably curved since curved blades will provide better resistance to distortion during the hardening process. The blades are preferably curved so that the working surface of the base of each blade is convex in the longitudinal direction of the blade.

Each bar may be welded to the base of a respective blade on the face remote from the sides of the blade.

The fan impeller may have two bars welded transversely across the base of each blade and the bars may be attached to the front plate and the back plate by means of bolts, or rivets. Preferably bolts passing through the plates and a bore in the bar are used.

By way of example one specific embodiment of a fan impeller according to the invention will now be described with reference to the accompanying drawings in which:

FIG. 4 is a section view along the line 4—4 of FIG. 3;

FIG. 5 is a side view of a blade assembly;

FIG. 6 is a view from below FIG. 5; and

FIG. 7 is a section view of a blade and one bar.

Figure 1:
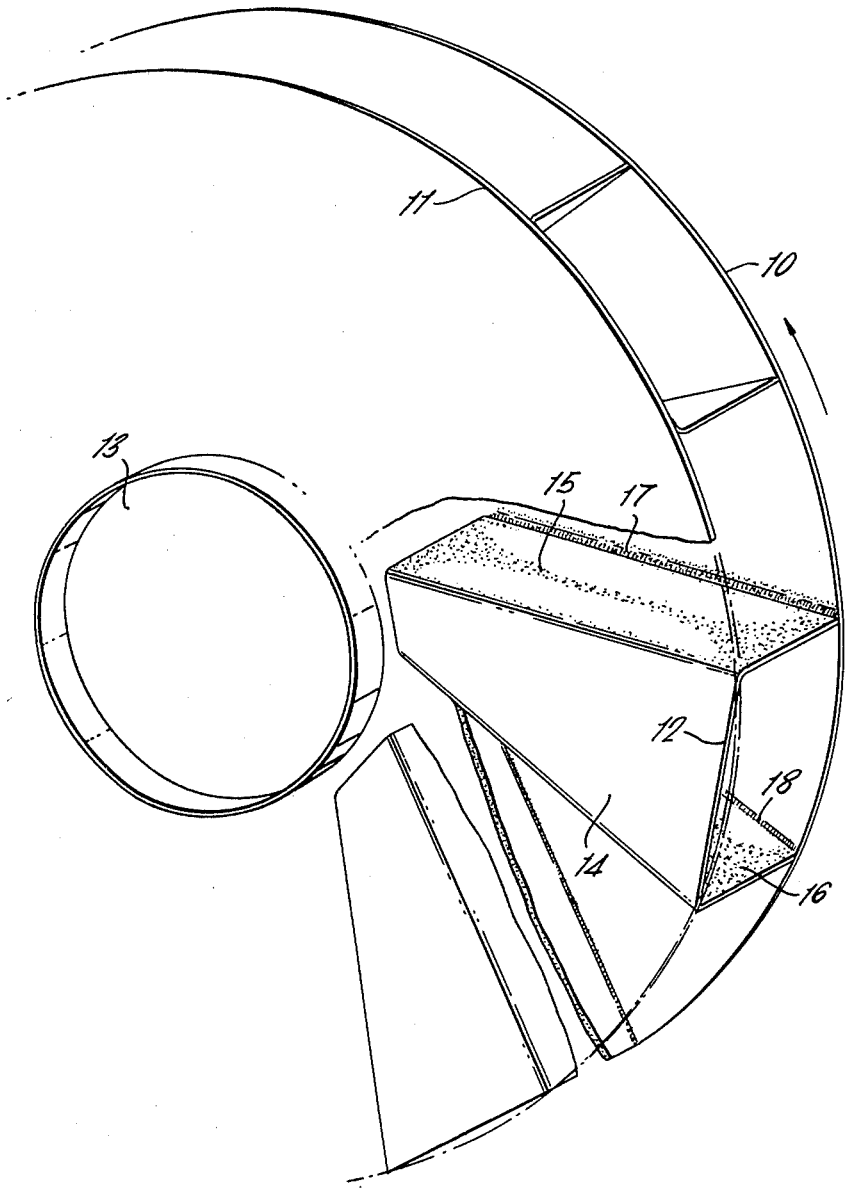
FIG. 1. PRIOR ART
FIG. 1 is a perspective view, partly in section, of a prior art impeller.

The prior art impeller shown in FIG. 1 is made of metal and comprises a circular back plate 10, a circular front plate 11 and a plurality of channel members 12. The impeller rotates about a hub 13. Each member 12 is of channel section having a base 14 of substantially trapezoidal shape and two sides 15 and 16, which form the blades of the impeller. The base 14 of each blade is plug welded to the front plate and the edges 17 and 18 of the sides 15 and 16 respectively are welded to the back plate.

In certain conditions of operation dust sometimes enters the fan and this can result in abrasion and gradual erosion of the impeller blades, particularly in the middle of the blades. Abrasion of the inside faces of the back and front plates also occurs along those parts immediately adjacent to the working faces of the blades. The erosion and abrasion in the middle of the blades particularly can lead to collapse of the blades and the construction of this impeller is such that, if the blades collapse, the impeller divides into two parts causing damage to the fan casing, and possibly to the machine as a whole and the driver.

Figure 2:
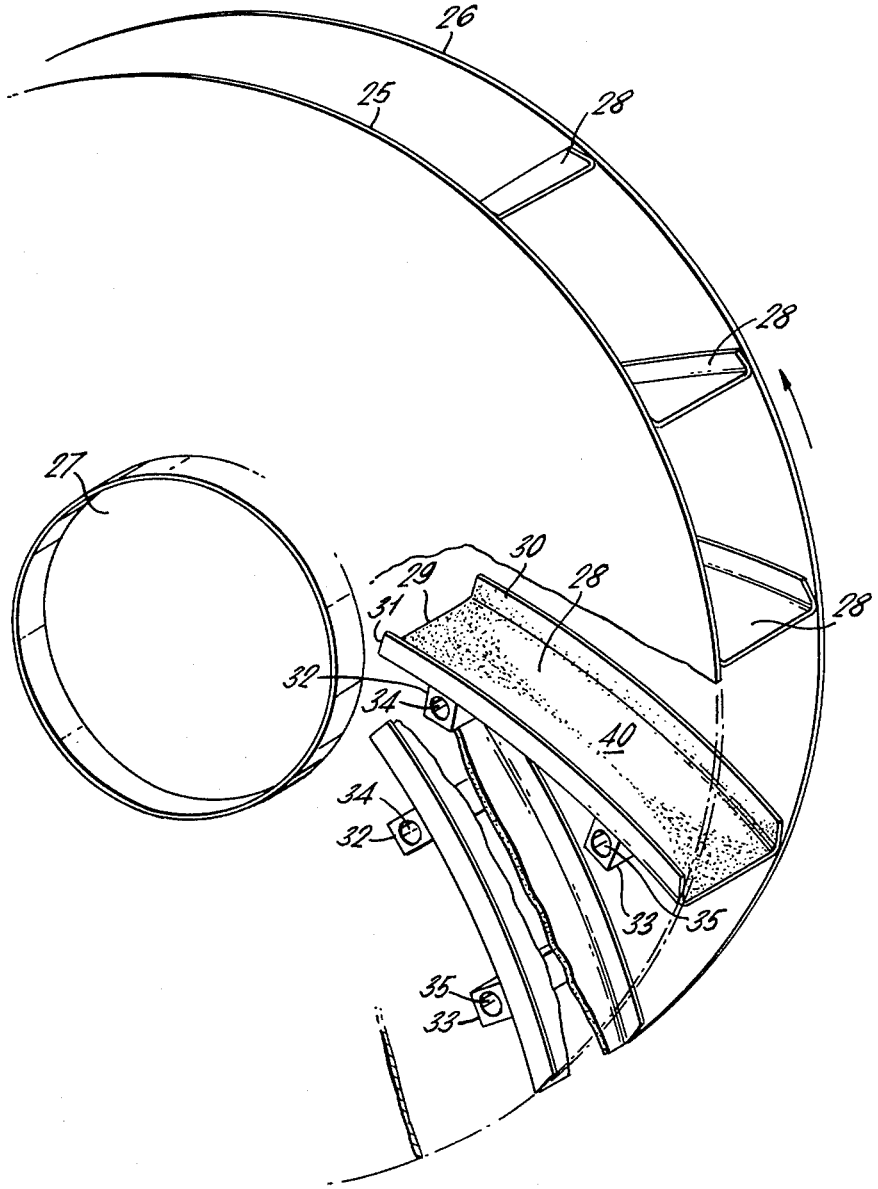
FIG. 2 is a perspective view, partly in section, of an impeller according to the invention.
Figure 3:
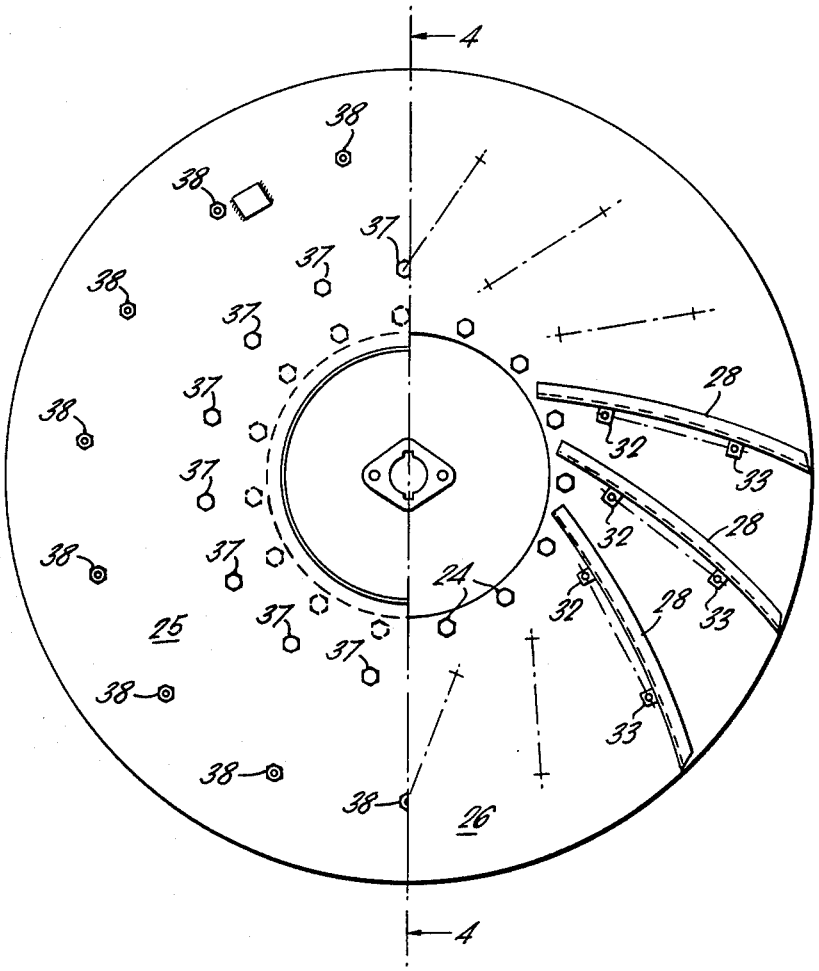
FIG. 3 is a view, partly in section, from the front of the impeller of FIG. 2.

In the preferred embodiment of the invention shown in perspective in FIG. 2 the front plate 25, the back plate 26 and the hub 27 are made of metal and are of the same design as the corresponding parts of the impeller of FIG. 1, the hub 27 being rigidly fixed to the back plate 26 by bolts 24. The blades 28 are of metal and of channel section having a base 29 lying perpendicular to the planes of the plates 25 and 26 and sides 30, 31 lying along plates 26 and 25 respectively. Each blade 28 has two metal bars 32 and 33 of square cross-section welded to the base 29. The bars 32, 33 have holes 34 and 35 respectively lengthways through them, and each blade is fixed to the front plate 25 and the back plate 26 by aligning the holes in the bars to holes correspondingly placed in the front plate 25 and back plate 26 and bolting through the plates 25 and 26 into the holes 34 and 35 in the bars 32 and 33 with bolts 36 and 37 and nuts 38 and 39 (FIGS. 3 and 4).

The blades are hardened to a minimum of Rockwell C55 on the working surface 40 to resist abrasion, and the working surface 40 of each blade is convexly curved in the longitudinal direction of the blade. The working surface 40 is the internal U-section surface defined by the base 29 and sides 30,31 of the blade.

The number and orientation of the blades is dependent on the working conditions and requirements of the impeller in particular cases.

One advantage of this embodiment of an impeller is that since the blades are hardened all over the working surface, the sides are able to prevent wear taking place on the back plate and front plate.

A further advantage is that if, after prolonged use, the blades eventually wear, the fan will not divide into two parts, as in the prior art impeller, because the bars will still hold the front plate to the back plate, producing a substantial increase in safety compared with the prior art impeller.

We claim:

1. A fan impeller comprising a back plate, a front plate, and a plurality of metal blades lying between the front plate and the back plate wherein each blade is of channel section having a base and two sides, the base of each blade lying normal to the planes of the front plate and the back plate, one side of each blade lying along the back plate, the other side of each blade lying along the front plate, and both sides of each blade extending from the base in the direction of rotation of the impellers in use, the inside working surface defined by the base and sides of each blade being hardened to a minimum hardness of Rockwell C55, the working surface of the base of each blade being convexly curved in the longitudinal direction of the blade, and wherein two bars are provided for each blade fixedly attached to the surface of the base of the respective blade remote from sides of the blade and extending between the front and back plates, the bars being spaced apart along the base of the blade and extending perpendicular to the front plate and back plate, the front plate the back plate and the blades being retained in assembled relation solely by bolts passing through the plates and through bores formed in the bars, the bolts fixedly attaching the bars to the front plate and the back plate.

* * * * *